US005114799A

United States Patent [19]

Ohashi et al.

[11] Patent Number: 5,114,799

[45] Date of Patent: May 19, 1992

[54] MATERIAL FOR ROOFING AND FACING

[75] Inventors: Hidetsugu Ohashi, Shinnanyo; Masayuki Kinugasa, Kure; Toshiro Adachi; Akihiro Nonomura, both of Shinnanyo; Waro Sekimoto, Yachiyo, all of Japan

[73] Assignees: Nisshin Steel Company, Ltd., Tokyo; Shinsei Kogyo Company, Ltd., Chiba, both of Japan

[21] Appl. No.: 645,101

[22] Filed: Jan. 24, 1991

[30] Foreign Application Priority Data

Jan. 30, 1990 [JP] Japan ..... 2-17980

[51] Int. Cl.[5] ..... B32B 15/04; B32B 15/18

[52] U.S. Cl. ..... 428/659; 428/685

[58] Field of Search ..... 428/658, 659, 621, 685

[56] References Cited

U.S. PATENT DOCUMENTS

| | | | |
|---|---|---|---|
| 3,713,902 | 1/1973 | Vrijburg et al. | 428/659 |
| 4,500,610 | 2/1985 | Gunn et al. | 428/658 |
| 4,533,606 | 8/1985 | Teng et al. | 420/513 |
| 4,885,215 | 12/1989 | Yoshioka et al. | 428/659 |
| 4,897,317 | 1/1990 | Kanamaru et al. | 428/659 |

FOREIGN PATENT DOCUMENTS

| | | | |
|---|---|---|---|
| 45-15851 | 6/1970 | Japan | 428/659 |
| 54-42693 | 4/1979 | Japan | 428/659 |
| 1-78832 | 3/1989 | Japan | 428/659 |
| 2161499A | 1/1986 | United Kingdom | 428/659 |

*Primary Examiner*—John Zimmerman

*Attorney, Agent, or Firm*—Webb, Burden, Ziesenheim & Webb

[57] ABSTRACT

Stainless steel sheets are plated with zinc and further phosphated so as to have chromaticness indices of L=45-53, a=0.0-0.4 and b=1.3-4.4. Thus treated stainless steel sheets have sufficient strength, excellent corrosion resistance and a color well harmonizing with other building materials and environment and do not suffer from color change for a prolonged period of time.

2 Claims, 1 Drawing Sheet

MATERIAL FOR ROOFING AND FACING

FIELD OF THE INVENTION

Figure 1:
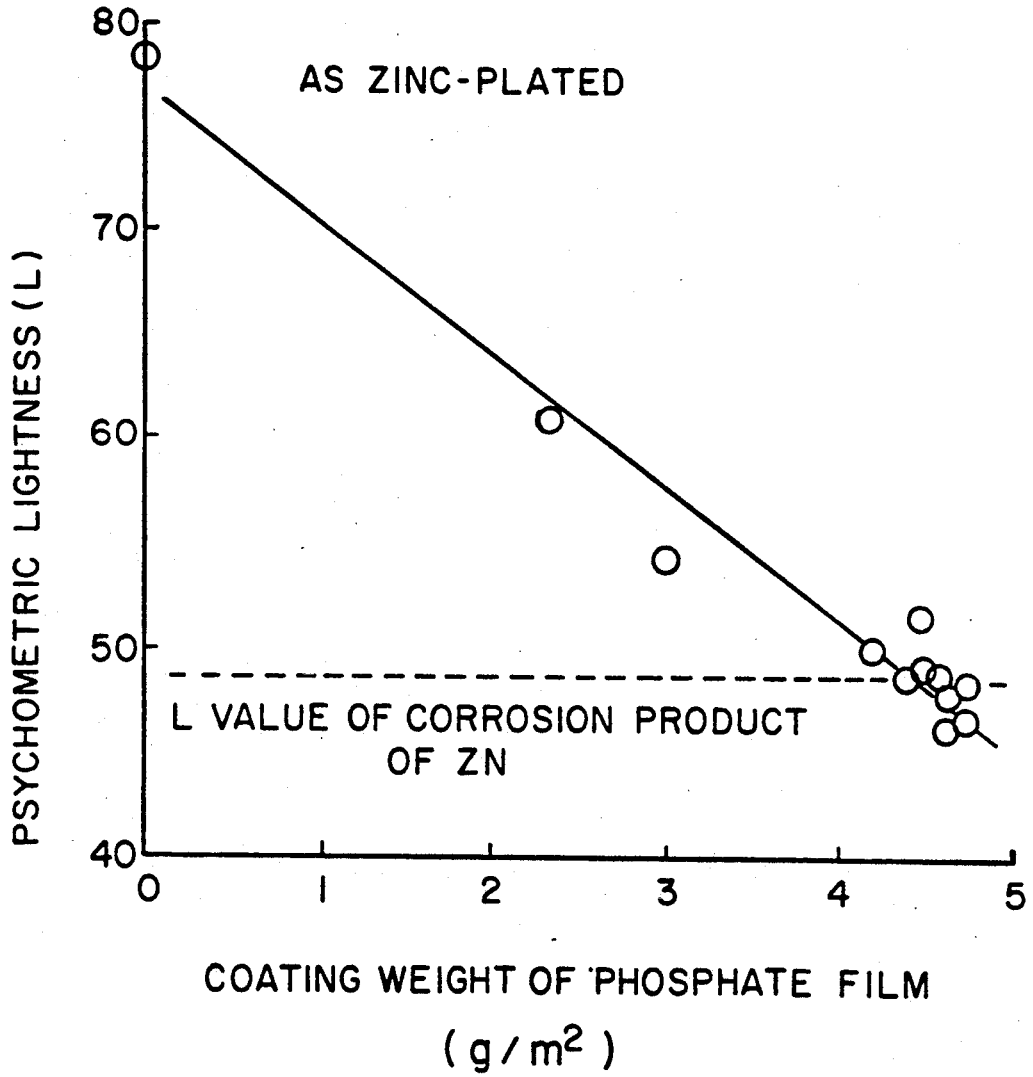

The present invention relates to a stainless steel building material for roofing and facing, which has excellent atmospheric-corrosion resistance.

BACKGROUND OF THE INVENTION

Copper sheets, aluminum sheets, atmospheric corrosion resistant steel sheets, stainless steel sheets, zinc alloy sheets, galvanized steel sheets, etc. have been conventionally used as metallic materials for roofing and facing in building.

Each metallic material has its advantages and disadvantages and these materials are selected in accordance with the intended use. Copper sheets, aluminum sheets, atmospheric-corrosion resistant steel sheets, stainless steel sheets, zinc alloy sheets and galvanized steel sheets have the following advantages and disadvantages.

Copper develops green rust (verdigris, a basic carbonate salt) on its surface. The tint of this rust imparts elegant appearance to the edifice and, therefore, copper has been used for Shinto shrines and Buddhist temples in Japan from olden times. However, copper causes galvanic corrosion of other metals that are used in combination with it. Aluminum, iron and zinc, which are baser than copper, corrode in the presence of copper. Also copper ions which are formed and washed out by rain water may stain the underlying materials. Further, the toxicity of copper ions may kill nearby plants. Among metals, copper is rather soft and, therefore, this material cannot be used in applications in which strength is required. Thus, steel sheets which are plated with copper are sometimes used. This material, of course, suffers from galvanic corrosion.

Aluminum is a very base metal but corrosion resistance is ensured by the oxide film which forms on the surface. However, it may suffer serious pitting depending upon the conditions in which it is used. Corrosion of aluminum starts from the points where dust, iron powder or chlorine ions adhere and, therefore, occasional cleaning is required. Frequent cleaning is necessary in seashore regions or heavily polluted places. Thus aluminum cannot be used for parts used where cleaning is difficult.

The corrosion resistance of atmospheric-corrosion resistant steel sheets is maintained by the dense rust formed on the surface by virtue of the alloying elements. Corrosion of atmospheric-corrosion resistant steel sheets starts from defect points of this surface rust and the produced red rust stains concrete and other materials and spoils the appearance of buildings.

Corrosion resistance of stainless steels is based on the passive films formed on the surface thereof. However, stainless steels often suffer from pitting or crevice corrosion, which produces red rust and spoils the appearance of buildings. Shining appearance of stainless steels does not harmonize with natural environments and, therefore, they are sometimes painted or subjected to other surface treatment.

Zinc is a base metal which is highly corrodible, However, it maintains its atmospheric-corrosion resistance by virtue of a basic corrosion product which forms on the surface. Zinc. protects other metals by sacrificial corrosion and thus is used for plating steel sheets. Corrosion of zinc produces white rust. Zinc has a larger expansion coefficient than other metals and, therefore, its use is restricted in environments where the temperature difference between day and night and between summer and winter is great. Also, zinc is very soft and its use is limited in the condition where strength is required. Therefore, zinc is used in the form of zinc alloys which are strengthened by alloying elements or zinc-plated (galvanized) steel sheets. However, galvanized steel sheets are not sufficient in corrosion resistance in some applications and suffer from formation of corrosion holes and generation of red rust.

These copper sheets, aluminum sheets, atmospheric-corrosion resistant steel sheets, stainless steel sheets, zinc alloy sheets and galvanized steel sheets are usually used as is. However, recently there is a trend in which coloring or decoration is desired in the exterior use and they are painted or given some surface treatment in such cases.

As has been described, copper, aluminum, atmospheric corrosion resistant steels, stainless steels, zinc, galvanized steel sheets are used in accordance with their advantages and disadvantage for intended use.

The properties required for roofing and facing materials are summarized as follows.

(1) To have sufficient atmospheric-corrosion resistance and minimal change in appearance (fading of color, reduction in luster, corrosion) under the environment in which they are used.

(2) To have sufficient strength as roofing and facing materials.

(3) To have a small expansion coefficient.

(4) To have a color harmonizing with the environment in which they are used.

SUMMARY OF THE INVENTION

This invention was made in order to overcome the shortcomings of the roofing and facing materials conventionally used and has the following constitution and effect.

This invention provides a roofing and facing material comprising a stainless steel sheet having a plated zinc layer or layers which are chemically treated so that the surface has a color tone defined by chromaticness indices of $L=45-52$, $a=0.0-0.4$, $b=1.3-4.4$.

The zinc layer may be formed by hot dip plating or electrolytic plating. Preferably, the zinc layer has a thickness of not less than a coating weight of $200g/m^2$ per side. Applicable chemical treatments are phosphating, chromating, etc. but phosphating is preferred. The thickness of the phosphate film is preferably of a coating weight of $4-5g/m^2$.

The substrate sheet is preferably of a ferritic steel from the viewpoint of the cost. However, the present invention is quite satisfactorily applicable to austenitic steel stainless sheets.

The reason why stainless steels are required is corrosion resistance and strength. Other materials will suffer from penetration by corrosion from the underside after construction. In the present invention, stainless steel sheets are used instead of conventional plain carbon steel sheets as substrates for zinc plating. This brings about excellent corrosion resistance which cannot be expected from conventional zinc-plated steel sheets. In the conventional zinc-plated steel sheet, corrosion is inhibited by sacrificial dissolution of zinc and, therefore, the substrate steel is corroded after the zinc has been consumed. This generates red rust, which spoils the appearance of the building. We checked the effect of plating stainless steel sheets with zinc and found that stainless steels are well protected not only by the sacrificial effect of zinc but also by the adherence of a corrosion product of zinc. Here, corrosion inhibition with the adherence of the corrosion product of zinc means as follows. The corrosion product which attaches to the stainless steel inhibits the oxygen reduction reaction which is a cathode reaction in the course of the corrosion and the dissociation of the corrosion product of zinc has a pH-buffering effect. This phenomenon was observed in case where stainless steels were used and not observed in the case of the plain carbon steel substrate sheets.

It is advantageous to use ferritic stainless steel sheets in designing and building work when the products are used in an environment where the temperature difference between day and night and between summer and winter is great.

According to the present invention, stainless steel sheets are plated with zinc preferably at a coating weight of not less than 200g/m$^2$ per side. This is preferable for improvement of corrosion resistance of stainless steels and the coloring treatment described below. The coating weight of the zinc plating is determined by considering the life of the product from the consumption or loss of zinc in the environment in which the product is used for roofing or facing. The consumption or loss of zinc in moderately corrosive environments such as mountain villages is about 5g/m$^2$ per annum and thus about 40 years of life can be expected from the zinc plating of a coating weight of no less than 200g/m$^2$ per side. In highly corrosive environments such as seashore regions, the loss of zinc is about 10g/m$^2$ per annum and thus about 20 years of life can be expected from the same product. In the case where the products of the present invention, in which stainless steel sheets are used as the substrate, are used, however, reduction of the consumption of zinc is expected and it is surmised that the materials of the present invention can be practically semipermanently used. If such a long life is not desired, the coating weight of not more than 200g/m$^2$ will suffice. It is well known that a zinc coating of not less than 200g/m$^2$ is more economically effected by the hot dip process than the electrolytic process.

The zinc-plated stainless steel sheet is colored preferably by the phosphating treatment. This is to modify the surface color of the zinc-plated stainless steel, which still has metallic luster and does not harmonize with natural environments. Also the coloring finishing is preferable since the lustrous surface of the zinc plating loses luster and turns white or further grayish white in the course of time by formation of the corrosion product and often such a material is not suitable as a roofing and facing material.

There are several methods of coloring finishing depending on the color of finish. The color of finish is selected so as to harmonize with the environment in which the material is used. It is advantageous to color the zinc-plated stainless steel sheets to grayish white or a similar color in view of the fact that the colored layer is not durable semi-permanently and the zinc layer turns grayish white sooner or later. Grayish white well matches the color of concrete and other building materials. As a result of extensive study, we have found that the surface of the zinc-plated stainless steel sheets can be colored grayish white by a chemical treatment and the desired color of the corrosion product of zinc, that is, L=45−52, a=0.0–0.4, and b=1.3–4.4 in chromaticness indices, can be obtained, if the thickness of the phosphate film is adjusted to 4.0–5.0g/m$^2$, for instance. When the thickness is less than 4.0g/m$^2$, the color tone (chromaticity and lightness) of the phosphate film differs from that of corrosion products of zinc as seen in the working examples described below. When the thickness is more than 5.0g/m$^2$, it is disadvantageous because it requires a longer treating time and the resulting phosphate film is liable to peeling off, although the color of the phosphate film is similar to that of the corrosion product of zinc. These are the reasons for defining the phosphate film thickness as above. It is only required that the chromaticness indices L, a and b fall within the defined values, irrespective by what chemical process other than the phosphating it is colored. The coating weight is suitably selected depending on the process employed.

Although the material of the present invention, has sufficient atmospheric-corrosion resistance as a roofing and facing material, it can be effectively subjected to the chromating treatment, for example, for the purpose of further improving corrosion resistance within an extent that the color tone is not changed.

Now the invention will be specifically described by way of working examples with reference to the attached drawing.

BRIEF DESCRIPTION ON OF THE DRAWING

FIG. 1 is a graph showing the relation between the coating weight of the phosphate film and the chromaticness index L.

SPECIFIC DISCLOSURE OF THE INVENTION

Example 1

A commercially available SUS430 (=AISI430) stainless steel cold-rolled sheet (0.4mm thick) was plated with zinc to 260–300g/m$^2$ by the hot dip process. This plated sheet was colored by phosphating with a phosphating solution indicated in Table 1.

TABLE 1

| Phosphating Solution | |
|---|---|
| ZnO | 2.1 g |
| $HNO_3$ | 1.6 g/l |
| $H_3PO_4$ | 5.8 g/l |
| $NaNO_3$ | 0.1 g/l |
| $NaClO_3$ | 0.1 g/l |
| Nonionic surfactant | 0.1 g/l |
| Deionized water to make | 1 liter |

The coating weight of the phosphate film was varied by varying the time and temperature of the treatment. The color tone (chromaticity and lightness) after the treatment was measured in accordance with the procedures of JIS-Z8721, and the results are indicated by L, a and b in Table 2. It was found that the color tone of the surface of the thus treated zinc-plated stainless steel sheet resembled that of the non-treated zinc-plated stainless steel sheet which had been exposed to the atmosphere for 10 years.

The L value (psychometric lightness) markedly changed by the phosphating treatment. The relation between the coating weight of the phosphate film was checked and the results are shown in FIG. 1. The color tone of the zinc-plated stainless steel sheet which had been exposed to the atmosphere for 10 years and those of the treated samples were compared and it is found that the color tone with L=45–52 is similar to that of the corrosion product of zinc and such color tone tone is achieved by a phosphate film of a coating weight of 4.0–5.0g/m$^2$.

Example 2

The same zinc-plated stainless steel sheet as used in Example 1 was treated with the phosphating solutions indicated in Table 3. The coating weight was 4.0–5.0g/m$^2$. The treated samples were subjected to an accelerated weathering test. As comparative materials, commercially available SUS304(AISI304) and SUS430(AISI430) sheets (0.4mm cold-rolled sheets pickled with a nitric acid-fluoric acid mixture) were used. The conditions of the accelerated weathering test are shown in Table 4 and the test results are shown in Table 5.

TABLE 2

| Run | Treating time (sec) | Treating temp. (°C.) | Phosphate coating wt. (g/m$^2$) | Color L | Color a | Color B | Remarks |
|---|---|---|---|---|---|---|---|
| 1 | 5 | 70 | 2.33 | 60.79 | 0.62 | 7.00 | Comparative |
| 2 | 10 | " | 3.00 | 54.02 | 0.61 | 4.86 | |
| 3 | 15 | " | 4.64 | 47.65 | 0.20 | 3.43 | Invention |
| 4 | 20 | " | 4.64 | 45.95 | 0.26 | 3.44 | |
| 5 | 25 | " | 4.72 | 46.34 | 0.16 | 3.44 | |
| 6 | 35 | " | 4.75 | 48.31 | 0.13 | 3.53 | |
| 7 | 45 | " | 4.59 | 48.65 | 0.08 | 3.10 | |
| 8 | 15 | 80 | 4.49 | 48.97 | 0.04 | 2.93 | |
| 9 | " | 75 | 4.40 | 48.84 | 0.07 | 2.96 | |
| 10 | " | 65 | 4.46 | 51.27 | 0.27 | 4.03 | |
| 11 | " | 60 | 4.20 | 49.74 | 0.37 | 4.39 | |
| 12 | Corrosion product of zinc on the Zn-plated steel sheet exposed for 10 years. | | | 47.42 | 0.21 | 3.05 | Reference |

TABLE 3

| Run | Conditions of Treatment | |
|---|---|---|
| A | $NaH_2PO_4$ | 10.0 g/l |
| | $NaClO_3$ | 5.5 g/l |
| | Nonionic surfactant | 0.2 g/l |
| | Deionized water | balance |
| | pH | 5.2 g/l($HNO_3$) |
| | Temperature | 75° C. |
| | Time | 20 sec |
| B | $Al(H_2PO_4)_3$ | 0.1 g/l |
| | $NH_4H_2PO_4$ | 9.3 g/l |
| | $Na_2HPO_4$ | 0.5 g/l |
| | $NaClO_4$ | 0.1 g/l |
| | Deionized water | balance |
| | pH | 5.2($H_3PO_4$) |
| | Temperature | 70° C. |
| | Time | 30 sec |
| C | Commercially available phosphating sol'n | |
| | Temperature | 65° C. |
| | Time | 30 sec |

TABLE 4

| 1 Cycle comprises: | |
|---|---|
| Salt spray | 10 minutes |
| Wetting | 30° C., RH 80%, 30 min |

TABLE 4-continued

| 1 Cycle comprises: |
|---|
| Drying |
| Washing with water |
| Drying |

TABLE 5

| Run | Before test L | Before test a | Before test b | After Test L | After Test a | After Test b | Rust | Remarks |
|---|---|---|---|---|---|---|---|---|
| A | 48.74 | 0.08 | 3.03 | 48.16 | 0.09 | 2.89 | Not obs'd | Invention |
| B | 48.93 | 0.41 | 4.39 | 49.92 | 0.38 | 4.51 | " | " |
| C | 49.03 | 0.06 | 2.89 | 49.31 | 0.04 | 2.90 | " | " |
| SUS430 | | | | | | | Pronounced | Comp'tive |
| SUS304 | | | | | | | Observed | |

No rust was observed on the surface of the phosphated zinc-plated stainless steel sheets after 80 cycles of the accelerated weathering test. In contrast, untreated stainless steels developed red rust. Thus it is apparent that phosphated zinc-plated stainless steels have excellent atmospheric-corrosion resistance.

As has been described above, the roofing and facing material of this invention has sufficient atmospheric-corrosion resistance in the environment in which it is used and suffers little deterioration of appearance such as color fading, loss of luster, corrosion, etc. As stainless steel is used as the substrate sheet, the material has satisfactory strength for roofing and facing and usable as a long roofing material. When ferritic stainless steel sheets are used, the material is advantageous for construction work in environments where temperature change is large because of its low expansion coefficient.

As long as the coating weight of the phosphate film is 130 4.0–5.0g/m$^2$, the same effect is attained even when treated under the conditions not exemplified in the above described working examples.

We claim:

1. A roofing and facing material comprising a ferritic stainless steel sheet having a hot-dip plated zinc layer or layers capable of forming a corrosion product and which are phosphated so that the surface of the phosphated material and the corrosion product have a color tone defined by chromaticness indices of L=45–52, a=0.0–0.4, b=1.3–4.4.

2. A roofing and facing material comprising a ferritic stainless steel as claimed in claim 1 wherein the thickness of the plated zinc layer or layers is not less than 200 g/m$^2$ and the thickness of the phosphated film is 4.0–5.0 g/m$^2$.

* * * * *